US007073344B2

(12) United States Patent
Luo et al.

(10) Patent No.: US 7,073,344 B2
(45) Date of Patent: Jul. 11, 2006

(54) ELECTRICALLY CONTROLLED DEFROST AND EXPANSION VALVE APPARATUS

(75) Inventors: Ran Luo, New Albany, MS (US); Kenneth W. Owen, New Albany, MS (US)

(73) Assignee: Standex International Corporation, Salem, NH (US)

( * ) Notice: Subject to any disclaimer, the term of this patent is extended or adjusted under 35 U.S.C. 154(b) by 0 days.

(21) Appl. No.: 10/888,561

(22) Filed: Jul. 9, 2004

(65) Prior Publication Data

US 2005/0011206 A1 Jan. 20, 2005

Related U.S. Application Data

(60) Provisional application No. 60/485,836, filed on Jul. 10, 2003.

(51) Int. Cl.
*F25D 21/00* (2006.01)

(52) U.S. Cl. ..... 62/234

(58) Field of Classification Search ..... 62/132, 62/151, 234, 324.1, 325, 155, 208, 222
See application file for complete search history.

(56) References Cited

U.S. PATENT DOCUMENTS

| | | | | |
|---|---|---|---|---|
| 3,633,377 | A * | 1/1972 | Quick | 62/192 |
| 4,730,662 | A * | 3/1988 | Kobayashi | 165/204 |
| 4,766,734 | A * | 8/1988 | Dudley | 62/160 |
| 5,118,038 | A * | 6/1992 | Shimizu et al. | 237/2 A |
| 5,497,629 | A * | 3/1996 | Rafalovich et al. | 62/98 |
| 5,546,756 | A * | 8/1996 | Ali | 62/204 |
| 5,755,282 | A * | 5/1998 | Teshima et al. | 165/202 |
| 6,334,321 | B1 * | 1/2002 | Said et al. | 62/155 |

FOREIGN PATENT DOCUMENTS

JP 7-190574 A * 7/1995

* cited by examiner

*Primary Examiner*—Mohammad M. Ali
(74) *Attorney, Agent, or Firm*—William B. Ritchie

(57) ABSTRACT

A cooling system that has an electrical controller that controls an electric expansion valve and the defrost cycle using a reversing valve. The need for heater circuit to achieve defrost is eliminated. The system permits the defrosting the evaporator system in less time required for conventional defrost methods. The cooling system also eliminates the need for a head pressure control valve and check valves. Due to the less wiring and lower operating costs, the invention provides significant cost savings.

3 Claims, 1 Drawing Sheet

ELECTRICALLY CONTROLLED DEFROST AND EXPANSION VALVE APPARATUS

This invention relates generally to space cooling systems, in particular to apparatus for controlling a space cooling system with respect to the defrost cycle. This application claims benefit of priority under 35 U.S.C. §119(e) to U.S. Provisional Application Ser. No. 60/485,836 filed on Jul. 10, 2003.

BACKGROUND OF THE INVENTION

Field of the Invention

A typical space cooling system includes at least one evaporator system contained within the space that is to be cooled, a condenser system that is located outside of the cooled space, and a compressor positioned between the condenser system outlet and the evaporator system inlet and, finally, an expansion valve which completes the loop joining together the condenser system outlet and the evaporator system inlet. A refrigerant is circulated within the loop which cools the space as follows. The refrigerant is compressed by the compressor which raises the temperature and pressure of the refrigerant. The hot pressurized refrigerant gas then flows through the condenser system which serves as heat exchanger to allow the refrigerant to dissipate the heat of pressurization. The refrigerant condenses into a liquid and then flows through the expansion valve, where the liquid refrigerant moves from a high pressure zone into a low pressure zone, thus expanding and evaporating. In evaporating, the refrigerant becomes cold where it then passes into coils of the evaporator, thus absorbing heat from inside the space that is to be cooled and the cycle then repeats until the space reaches the desired temperature.

In addition to these major components, additional components are also included. A fan assist the heat transfer from the cooled space to the coils of the evaporator system and another fan is used to assist the heat transfer from the coils of the condenser to outside environment. A negative pressure differential is present on the evaporator outlet when the device is operating in a refrigeration mode thereby suctioning the gas refrigerant to the compressor. Further, thermistor sensors are placed at the inlet and outlet of the evaporator system for measuring the level of superheat across the evaporator. A sensor located on the outlet side of the compressor measures the discharge temperature of compressor. The ambient temperature of the spaced to be cooled is measured by still another sensor. Finally, the need to defrost the evaporator from any ice build-up due to the cooling process is determined by another sensor that is associated with evaporator so that defrosting procedures can be monitored.

There are two basic options for providing a defrost cycle. U.S. Pat. No. 5,551,248, issued to Derosier on Sep. 3, 1996, discloses the use of a controller to control the operation of a space cooling system. While this device permits the use of an electrically controlled expansion valve, either utilizing an electrically operated solenoid or an electrically operated step motor, Derosier also teaches the use of heater which is activated on a programmed time schedule, either a time between successive defrost cycles or a compressor run time. The use of heater for providing defrost function requires the additional expense of the heater as well as associated valving, piping and supply wiring connections. Additionally, there must a pumpdown condition present before defrost procedures can begin and the fans must remain on during pumpdown.

Another option is disclosed by Russell of Brea, Calif. in its HIGH SIERRA model refrigeration device. This device teaches the use of reversing valve which permits the elimination of the heater. However, the HIGH SIERRA model requires the use of check valve at the outlet of the compressor and another check valve in the drain pan circuit as well as additional piping and connection fittings. Most importantly, the HIGH SIERRA model does not disclose or suggest the use of an electrical controller which permits, among other things, the use of electrically controlled expansion valve such as taught by Derosier.

An refrigeration apparatus that has both an electrical controller that responds to evaporator superheat and return air temperature to the expansion valve as well as controls a reversing valve which provides for a defrosting cycle, eliminates the need for electric heaters, check valves, head pressure control valve as well as the associated piping and connections is not found in the prior art.

SUMMARY OF THE INVENTION

It is an aspect of the invention to provide a refrigeration system that provides an electrical controller that controls the electric expansion valve and the defrost cycle using a reversing valve.

It is another aspect of the invention to provide a refrigeration system that eliminates the need for a heater circuit to achieve a defrost of the evaporator system.

It is still another aspect of the invention to provide a refrigeration system that permits defrosting the evaporator system in less than the time required for a conventional electronic defrost system.

Further, another aspect of the invention is to provide a refrigeration system that leaves the evaporator coil virtually clean after each defrost cycle.

It is another aspect of the invention to provide a refrigeration system that eliminates the need for a head pressure control valve.

Another aspect of the invention is to provide a refrigeration system that eliminates the need for check valves and an expansion valve at the condenser.

Still another aspect of the invention is to provide a refrigeration system that has less wiring and is less expensive to produce and operate than present devices.

It is another aspect of the invention to provide a refrigeration system that requires no pumpdown before the defrost cycle has been initiated.

It is another aspect of the invention to provide a refrigeration system that enables the compressor to run during defrost.

It is still another aspect of the invention to provide a refrigeration system wherein the need to defrost is determined by the controller and defrost will only occur when it is necessary thus saving energy costs associated with unnecessary defrost.

Finally, it is another aspect of the invention to provide a refrigeration system that prevents steaming and heat from being introduced into the cooled space during the defrost cycle.

These and other aspects of the invention will become apparent in light of the detailed description of the invention which follows.

DESCRIPTION OF THE PREFERRED EMBODIMENTS

While certain representative embodiments of the invention have been described herein for the purposes of illustration, it will be apparent to those skilled in the art that modification therein may be made without departure from the spirit and scope of the invention. Like parts are referenced in the specification and accompanying figures with the same reference call out numbers. Note that the drawings are not necessarily to scale and that some elements may be larger or smaller or otherwise oriented to more clearly depict the important features of the invention.

Figure 1:
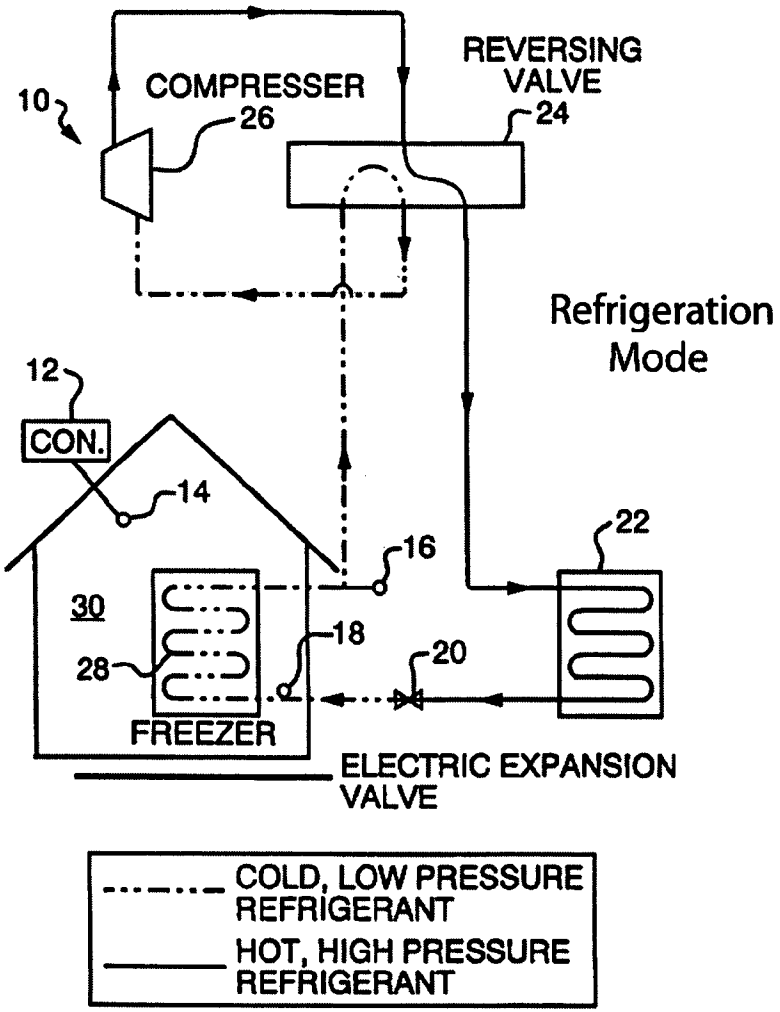
FIG. 1 is a schematic of the most basic embodiment of the invention operating during a refrigeration cycle.

As shown in FIG. 1, which depicts the basic elements of the invention 10, the refrigeration cycle is similar to that discussed above for the typical space cooling device discussed in the background. However, note that unlike prior art devices, invention 10 includes both a controller 12 and a reversing valve 24 which are discussed below. Refrigerant (not shown) is compressed by the compressor 26. The temperature and pressure of the refrigerant is raised. The hot pressurized refrigerant gas then flows through the reversing valve 24 to the condenser system 22. As above, condenser system 22 functions as a heat exchanger to allow the refrigerant to dissipate the heat of pressurization. The refrigerant condenses into a liquid and then flows through the expansion valve 20, where the liquid refrigerant moves from a high pressure zone into a low pressure zone, thus expanding and evaporating. Electric expansion valve 20 is preferably a step motor such as manufactured by companies such as Sporlan, Alco, Parker or Danfoss. The refrigerant flow of the electric expansion valve 20 is controlled by controller 12 and is modulated to control the superheat of the evaporator 28. The superheat of evaporator 28 is determined by measuring sensor 16 and 18 using techniques well known in the art. In evaporating, the refrigerant then passes into coils of the evaporator 28, thus absorbing heat from inside the space 30 that is to be cooled and the cycle then repeats until the space reaches the desired temperature as provided by sensor 14.

Figure 2:
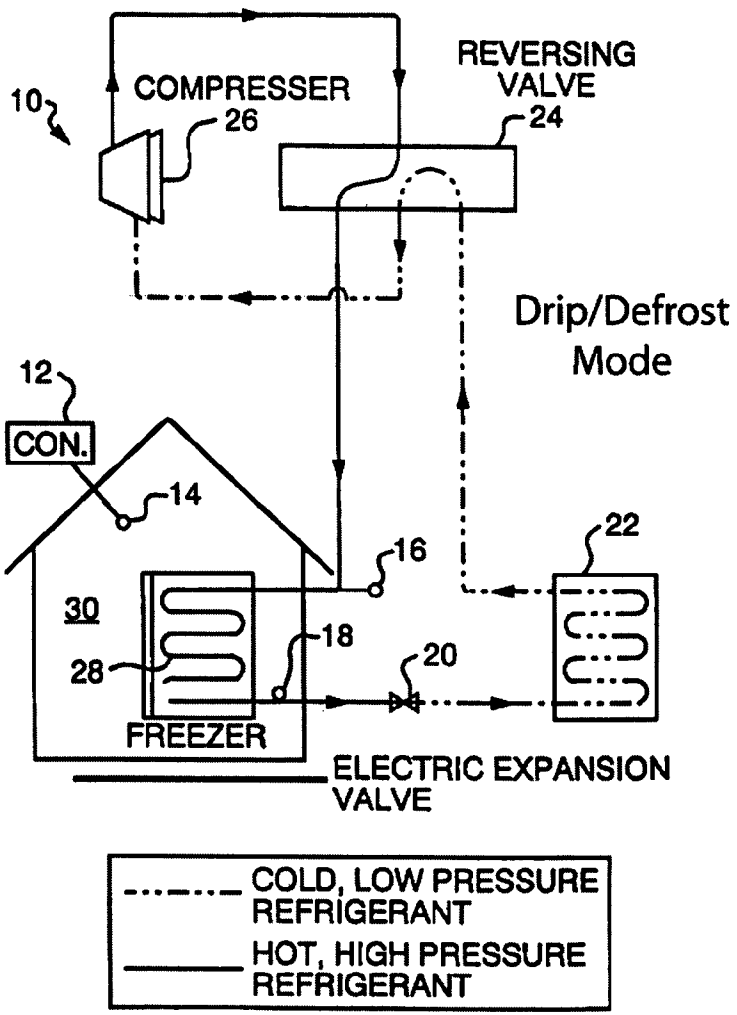
FIG. 2 is a schematic of the embodiment shown in FIG. 1 operating during a defrost cycle.

The controller 12 can be set to defrost mode that is either electric (using standard heater technology) or reverse cycle (utilizing the instant invention). When the reverse cycle defrost option is selected, the following sequence will be used as shown in FIG. 2.

When there is a demand for defrost whether by set time schedule or manual defrost or demand defrost as determined by the controller 12, the controller 12 sends a signal to reverse valve assembly 24. Reverse valve assembly 24 is readily available from companies such as Ranco, Alco, Danfoss and Sanhua. This type of valve is typically used on heat pumps. As shown in FIG. 2, the refrigerant flows change from refrigerating cycle to defrost cycle.

Simultaneously, the electrical expansion valve 20 is forced open ranging from 40% to 60% of maximum. Controller 12 then checks sensors 16 and 18. If the temperature at sensor 18 indicates that it is greater than or equal to the defrost termination temperature (DTT), the defrost ends and then goes to a drip mode. The default setting on controller 12 is preferably ranges from 40° F. to approximately 50° F. If 40° F.>Sensor 16−DTT>20° F., expansion valve 20 is changed ranging from 20% to 30% of the fully open position. The temperature monitored at sensor 16 will keep rising. If 99° F.>sensor 16>=40° F.+DTT, the controller 12 will again close the expansion valve 20 ranging from 5% to 15% of the fully open position. Sensor 18 will continue to be monitored to determine whether the DTT temperature has been reached. As noted, once it has, the defrost ends. This process will repeat until sensor 18 indicates that the DTT temperature has been reached and then defrost ends.

The sensor 18 is monitored continuously by controller 12 to determine the coil temperature rise of evaporator 28 relative to the DTT temperature. When the temperature reading on sensor 18 is greater than or equal to the pre-set DTT, defrost is considered to be complete and controller 12 will enter the drip mode and close the expansion valve 20 completely. Compressor 26 may pumpdown the refrigerant and may be cut off by the low-pressure control of compressor 26. While the compressor 26 is engaged in the pumpdown mode, the evaporator fans (not shown) remain off. Compressor 26 may also be shut off by controller 12 if so wired.

Reversing valve assembly 24 is not de-energized until the end of the drip mode. The refrigerant flows change from defrost cycle to refrigerating cycle when controller 12 enters the fan delay mode (cool mode if the fan delay mode is skipped) after drip mode. If the pumpdown after a defrost cycle takes longer than drip medel mode, the controller 12 will enter fan delay mode even though the pumpdown may not be completed. For example, if a pumpdown takes 4 minutes to complete and the drip time is pre-set to 3 minutes, when the 3 minute drip time expires, controller 12 will enter fan delay mode and expansion valve 20 will be modulating. Note the compressor 26 may be running through pumpdown mode, drip mode and fan delay mode. A reverse cycle defrost is considered complete when the controller 12 enters the fan delay mode. As noted above, when there is no defrost, all operations are the same as current version of the applicant's electric expansion valve refrigeration control system which is well known in the art.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A refrigeration system for a cooling a space comprising:

a compressor to compress a refrigerant gas;

a reversing valve connected to said compressor;

a condenser connected to said reversing valve which receives the hot pressurized refrigerant gas provided by said compressor; wherein said condenser functions as a heat exchanger to allow the refrigerant gas to dissipate the heat of pressurization such that the refrigerant condenses into a liquid;

an electric expansion valve connected to said condenser wherein the refrigerant passing through said expansion valve expands and evaporates;

a controller electrically connected to said electric expansion valve and to said reversing valve further comprising:

a cooling space temperature sensor that indicates the temperature in the cooled space so that said controller can control the cooling cycle of said refrigeration system;

a first evaporator temperature sensor positioned adjacent to the evaporator on the connection between said evaporator and said electric expansion valve;

a second evaporator temperature sensor positioned on the connection between said evaporator and said compressor wherein said second evaporator temperature sensor is adjacent to said evaporator but outside the cooled space;

wherein the superheat of said evaporator is determined by said controller by measuring said first evaporator temperature sensor and said second evaporator temperature sensor; and wherein said controller modulates the superheat of said evaporator until the predetennined temperature is reached; and wherein once said controller is set to defrost cycle, said controller causes said reversing valve to reverse, said electrical expansion valve is further opened, and said refrigeration system enters a defrost mode; and wherein if said second evaporator temperature sensor indicates to said controller that the temperature is greater than or equal to a defrost termination temperature set in said controller, said controller ends the defrost cycle and causes said refrigeration system to enter a drip mode.

2. The refrigeration system of claim 1 wherein the defrost termination temperature is preferably ranges from 40 to 50 degrees Fahrenheit.

3. The refrigeration system of claim 2 wherein said second evaporator temperature sensor is monitored by said controller to determine the temperature rise of said evaporator relative to the defrost termination temperature.

* * * * *